US012473920B2

(12) United States Patent
Mlsna

(10) Patent No.: US 12,473,920 B2
(45) Date of Patent: Nov. 18, 2025

(54) LUBRICATION SYSTEM FOR COMPRESSORS

(71) Applicant: TRANE INTERNATIONAL INC., Davidson, NC (US)

(72) Inventor: Eric S. Mlsna, Cashton, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 0 days.

(21) Appl. No.: 18/490,952

(22) Filed: Oct. 20, 2023

(65) Prior Publication Data

US 2025/0129783 A1 Apr. 24, 2025

(51) Int. Cl.

| | |
|---|---|
| ***F04C 29/02*** | (2006.01) |
| ***F04C 18/02*** | (2006.01) |
| ***F25B 31/00*** | (2006.01) |
| *F04C 23/00* | (2006.01) |

(52) U.S. Cl.

CPC ..... *F04C 29/023* (2013.01); *F04C 18/0215* (2013.01); *F04C 29/025* (2013.01); *F25B 31/002* (2013.01); *F04C 23/008* (2013.01); *F04C 2240/50* (2013.01); *F04C 2240/60* (2013.01); *F04C 2240/603* (2013.01); *F04C 2240/809* (2013.01)

(58) Field of Classification Search

CPC .. F04C 29/023; F04C 18/0215; F04C 29/025; F04C 2240/50; F04C 2240/60; F04C 2240/809; F04C 23/008; F04C 29/02; F04C 2240/603; F25B 31/002

See application file for complete search history.

(56) References Cited

U.S. PATENT DOCUMENTS

| | | | | |
|---|---|---|---|---|
| 4,702,681 | A * | 10/1987 | Inaba | F04C 29/023 418/94 |
| 4,875,840 | A * | 10/1989 | Johnson | F04C 29/023 418/55.6 |
| 4,877,381 | A * | 10/1989 | Johnson | F04C 29/023 418/94 |
| 4,997,349 | A * | 3/1991 | Richardson, Jr. | F04C 29/023 418/55.6 |
| 7,670,120 | B2 * | 3/2010 | Ginies | F04C 29/023 418/94 |
| 7,819,644 | B2 | 10/2010 | Eber et al. | |

(Continued)

FOREIGN PATENT DOCUMENTS

| | | | | |
|---|---|---|---|---|
| EP | 3232061 | A1 | 10/2017 | |
| JP | 2001065474 | A * | 3/2001 | F04C 18/0215 |
| WO | WO-2006125908 | A1 * | 11/2006 | F04C 23/008 |

OTHER PUBLICATIONS

Extended European Search Report issued in European Patent Application No. 24207644.6, Jan. 7, 2025 (9 pages).

*Primary Examiner* — Theresa Trieu
(74) *Attorney, Agent, or Firm* — HSML P.C.

(57) ABSTRACT

A compressor includes a lubricant pump and a shaft having a lubricant vent extending through the shaft. The vent has an outlet, which can be provided below a stator-rotor assembly of a motor of the compressor. The shaft can be used in a variable speed compressor to convey excess lubricant when the pump is over-supplying lubricant due to operation at speeds greater than the minimum speed. The vent can be positioned at a center of the shaft. The outlet of the vent can direct gas and/or lubricant onto windings of the stator so as to provide cooling.

17 Claims, 4 Drawing Sheets

(56) References Cited

U.S. PATENT DOCUMENTS

| | | | | |
|---|---|---|---|---|
| 2002/0063017 | A1* | 5/2002 | Paczuski | F04B 39/0261 184/6.16 |
| 2005/0053506 | A1* | 3/2005 | Cho | F04C 23/001 418/23 |
| 2007/0003424 | A1* | 1/2007 | Benco | F04C 18/0215 418/55.3 |
| 2008/0170955 | A1* | 7/2008 | Eber | F04C 18/0215 418/55.6 |
| 2009/0035168 | A1 | 2/2009 | Ginies et al. | |
| 2016/0208803 | A1 | 7/2016 | Uekawa et al. | |
| 2018/0023569 | A1* | 1/2018 | Branch | F04C 18/0215 418/55.2 |
| 2018/0245595 | A1* | 8/2018 | Mlsna | F25B 1/04 |
| 2019/0032664 | A1* | 1/2019 | Crum | F04C 29/023 |
| 2021/0148362 | A1* | 5/2021 | Ignatiev | F04C 29/023 |

* cited by examiner

LUBRICATION SYSTEM FOR COMPRESSORS

FIELD

This disclosure is directed to a lubrication system for a compressor, particularly having a vent for releasing excess oil in a variable-speed compressor.

BACKGROUND

Compressors and other devices using motors to drive shafts can lubricate components by using a fixed-displacement pump to drive a lubricant from a sump to bearings where the lubricant is required.

SUMMARY

This disclosure is directed to a lubrication system for a compressor, particularly having a vent through a shaft for releasing excess oil in a variable-speed compressor.

Variable-speed compressors require that lubricant pumps provide a suitable amount of lubricant when the variable-speed compressor is being operated at its lowest speed. The lubricant pumps are typically fixed-displacement pumps, and thus at higher speeds, lubricant can be oversupplied. By providing the vent, excess lubricant can be directly returned to the sump.

The vent can be provided within the crankshaft, for example at the center thereof, such that the vent receives lubricant after other surfaces due to centrifugal force within the compressor. The vent can thereby return lubricant to the sump primarily when the other surfaces are sufficiently lubricated. The vent can be provided in a position below the rotor-stator assembly, such that the lubricant does not become entrained with the gas in the compressor. In an embodiment, the vent can be positioned where stator windings can be contacted by gas and/or lubricant exiting the vent, thereby providing at least some cooling to the motor in addition to allowing the removal of excess lubricant.

In an embodiment, a compressor includes a stator, a shaft, a rotor connected to the shaft, a lubricant sump, a lubricant pump, and a lubricant channel configured to convey lubricant from the lubricant pump to a distal end of the shaft. At least a portion of the lubricant channel extends through at least a portion the shaft. The compressor further includes a vent extending through at least a portion of the shaft, the vent having an inlet at the distal end of the shaft, and an outlet disposed on a side wall of the shaft, between the lubricant sump and the rotor along the length of the shaft.

In an embodiment, the compressor is a variable speed compressor. In an embodiment, the compressor includes an orbiting scroll and a fixed scroll. In an embodiment, the inlet of the vent is located at a center of the distal end of the shaft. In an embodiment, the lubricant pump is a positive displacement pump. In an embodiment, the vent is positioned such that at least some of the fluid leaving the outlet contacts the stator when the compressor is in operation. In an embodiment, the compressor further includes a plurality of bearing surfaces configured to receive lubricant from the distal end of the shaft when the compressor is in operation.

In an embodiment, a heating, ventilation, air conditioning, and refrigeration (HVACR) system includes a compressor as described herein.

In an embodiment, the HVACR system further includes a condenser, an expander, and an evaporator. In an embodiment, the compressor is a variable speed compressor. In an embodiment, the compressor includes an orbiting scroll and a fixed scroll. In an embodiment, the inlet of the vent is located at a center of the distal end of the shaft. In an embodiment, the lubricant pump is a positive displacement pump. In an embodiment, the vent is positioned such that at least some of the fluid leaving the outlet contacts the stator when the compressor is in operation. In an embodiment, the HVACR system further includes a plurality of bearing surfaces configured to receive lubricant from the distal end of the shaft when the compressor is in operation.

In an embodiment, a method includes operating a compressor and operating a lubricant pump included in the compressor to drive lubricant through a lubricant channel. The lubricant channel extends through at least part of a shaft of the compressor. The method further includes lubricating one or more bearing surfaces of the compressor using at least some of the lubricant and receiving excess lubricant at an inlet of a vent. The vent extends through at least part of the shaft of the compressor. The method further includes releasing the excess lubricant from the vent at an outlet.

In an embodiment, releasing the excess lubricant from the vent at the outlet directs the excess lubricant to contact a stator of the compressor. In an embodiment, the lubricant pump is a positive displacement pump or a centrifugal pump. In an embodiment, the compressor is a variable-speed compressor. In an embodiment, operating the compressor compresses a working fluid of a heating, ventilation, air conditioning, or refrigeration (HVACR) system.

DRAWINGS

DETAILED DESCRIPTION

This disclosure is directed to a lubrication system for a compressor, particularly having a vent for releasing excess oil in a variable-speed compressor.

Figure 1:
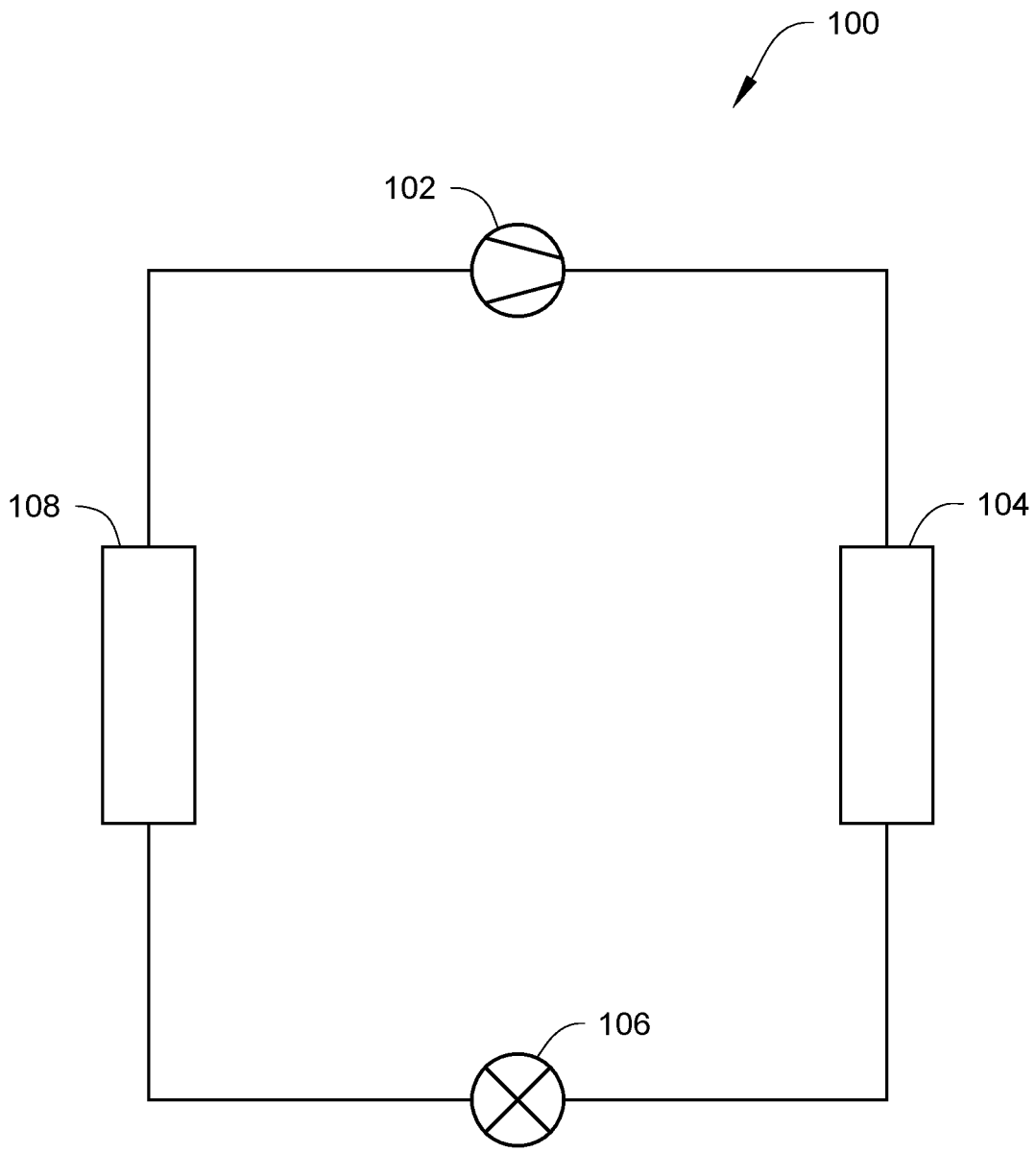
FIG. 1 shows a schematic of a heating, ventilation, air conditioning and refrigeration system according to an embodiment.

FIG. 1 shows a schematic of a heating, ventilation, air conditioning and refrigeration (HVACR) system according to an embodiment. HVACR system 100 includes a compressor 102, a condenser 104, an expander 106, and an evaporator 108.

HVACR system 100 is a working fluid circuit configured to circulate a working fluid. The HVACR system 100 can be included in an air conditioner, a heat pump, a refrigeration device, combinations thereof, and the like.

Compressor 102 is a compressor configured to compress the working fluid. Compressor 102 can be any compressor as described herein. In operation, the compressor 102 compresses a working fluid (e.g., a heat transfer fluid such as a refrigerant or the like) from a relatively lower pressure gas (e.g., suction pressure) to a relatively higher-pressure gas (e.g., discharge pressure). In an embodiment, the compressor 102 can be a positive displacement compressor. In an embodiment, the positive displacement compressor can be a screw compressor, a scroll compressor, a reciprocating compressor, a rotary compressor, or the like.

The relatively higher-pressure gas is at a relatively higher temperature, which is discharged from the compressor 102 and flows to the condenser 104. The working fluid flows through the condenser 104 and rejects heat to a process fluid (e.g., water, air, or the like), thereby cooling the working fluid.

The cooled working fluid can then flow to the expander 106. The expander 106 reduces the pressure of the working fluid. In an embodiment, the expander 106 can be an expansion valve, expansion plate, expansion vessel, orifice, or the like, or other suitable types of expansion mechanisms. It is to be appreciated that the expander 106 may be any type of expander used in the field for expanding a working fluid to cause the working fluid to decrease in temperature and pressure.

The working fluid flows to the evaporator 108. The working fluid flows through the first evaporator 108, where it absorbs thermal energy from a process fluid (e.g., water, air, or the like), thereby heating the working fluid. In some embodiments, at least a portion of the heated working fluid absorbs thermal energy in the evaporator 108 and evaporates to provide a vapor stream of the working fluid. The vapor stream can be provided to the compressor to continue the cycle through the circuit. The vapor stream can carry some working fluid in a liquid form due to, for example, the updraft near a liquid-vapor interface of the working fluid in the first liquid-vapor separator 108, creating entrained droplets.

While HVACR system 100 is shown as a simple circuit, it is understood that HVACR system can be according to any known suitable configuration for a working fluid circuit, including different piping and/or component arrangements, further elements such as flow reversers or other flow controls, additional heat exchangers, economizers, subcoolers, and the like.

Figure 2:
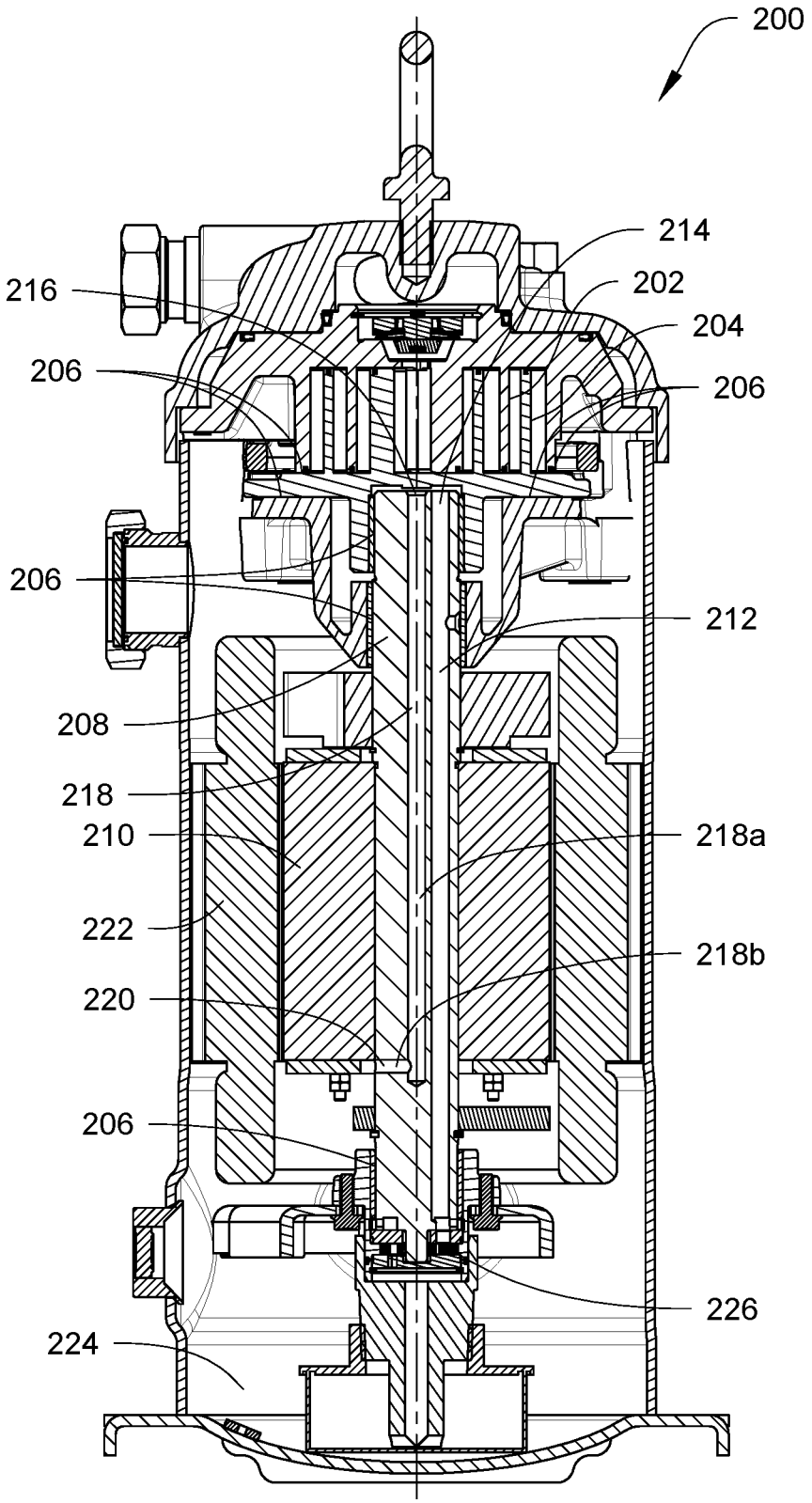
FIG. 2 shows a sectional view of a compressor according to an embodiment.

FIG. 2 shows a sectional view of a compressor according to an embodiment. Compressor 200 includes fixed scroll 202, orbiting scroll 204, and bearing surfaces 206. Compressor 200 further includes a shaft 208. Shaft 208 includes rotor 210, lubricant channel 212, lubricant outlet 214, vent opening 216, vent 218, and vent outlet 220. The compressor 200 further includes stator 222. Compressor 200 additionally includes lubricant sump 224 and lubricant pump 226.

Compressor 200 is a compressor configured to compress a fluid, such as a working fluid of an HVACR system. Compressor 200 is a compressor including rotational components driven by shaft 208. In an embodiment, the compressor 200 is a scroll compressor, which uses the fixed scroll 202 and orbiting scroll 204 to compress the fluid. Fixed scroll 202 is a scroll provided in a position that is fixed relative to the body of compressor 200. Orbiting scroll 204 is a scroll driven to move by shaft 208. The orbiting scroll is configured to cooperate with fixed scroll 202 to define compression chambers in which the working fluid is compressed as the working fluid travels from a suction of compressor 200 to the discharge of compressor 200. In an embodiment, the compressor 200 is a variable-speed compressor configured to be driven at a plurality of different speeds over the course of operation. In an embodiment, the stator 222 and/or rotor 210 are connected to a variable frequency drive (VFD) (not shown) configured to supply power such that the compressor 200 can be operated at the various speeds. In an embodiment, the stator 222 and rotor 210 can be configured for multi-speed operation, for example as parts of a multiple pole pair motor such as a 2/4 pole pair motor. In an embodiment, the stator 222 and/or rotor 210 can be driven by a variable input power frequency, for example from a generator that can be driven at different speeds.

Bearing surfaces 206 at the interfaces of various parts of compressor 202 that move relative to one another, such as portions of the orbiting scroll 204 and the respective interfaces thereof with shaft 208, fixed scroll 202, and any other suitable elements of compressor 200 such as a body of the compressor, couplings included in the compressor 200, and the like. The bearing surfaces 206 can be, for example, thrust bearings, journal bearings, or any other suitable bearing of compressor 200 that can require lubrication. The bearing surfaces can be configured to use a lubricant to facilitate the relative movement and to reduce friction between the respective parts providing the corresponding bearing surfaces 206. In an embodiment, at least some of bearing surfaces 206 are radially outwards of shaft 208.

Shaft 208 is a shaft provided within compressor 200 to drive rotating or otherwise movable parts when the shaft 208 is rotated. A non-limiting example of a part driven by rotation of shaft 208 is the orbiting scroll 204, when compressor 200 is a scroll compressor. Orbiting scroll 204 can move in an orbiting motion driven by a coupling between the orbiting scroll 204 and shaft 208. Shaft 208 can be rotated by an electric motor including rotor 210 and stator 222. The rotor 210 can be fixed to shaft 208. The shaft 208 can be an elongate body. In an embodiment, shaft 208 has a circular cross-sectional shape. In an embodiment, a portion of shaft 208 has a center line that is offset from a center line of the rest of the shaft 208.

Rotor 210 is a rotor for an electric motor that is fixed to shaft 208, such that shaft 208 can be rotated by the interaction between electrical current in windings of the stator 222 the rotor 210. Rotor 210 can include any suitable features for allowing rotor 210 to be driven to rotate, such as, as non-limiting examples, magnets, a "squirrel cage" of an induction motor, and the like. Rotor 210 extends along a portion of the length of shaft 208.

Lubricant channel 212 is a channel extending through at least a portion of shaft 208. In an embodiment, lubricant channel 212 extends an entire length of the shaft 208. The lubricant channel 212 can be configured to receive lubricant from a lubricant pump 226 and convey the lubricant to lubricant outlet 214. In an embodiment, lubricant channel 212 is a straight hole extending through the shaft 208 in a length direction thereof. In an embodiment, lubricant channel 212 is offset from a center line of the shaft 208. Lubricant outlet 214 is an opening provided where lubricant channel 212 ends. The lubricant outlet 214 can be provided at or near an end of shaft 208 that toward the distal end relative to where lubricant pump 226 is provided in compressor 200 (herein the "distal end"). In an embodiment, the end of the shaft 208 where lubricant outlet 214 is provided is an end where the shaft 208 interfaces with the orbiting scroll 204. Lubricant leaving the lubricant channel 212 at lubricant outlet 214 can be driven outwards by centrifugal force from the rotation of shaft 208, such that the lubricant is directed towards the bearing surfaces 206.

Vent opening 216 is provided at the distal end of shaft 208. Vent opening 216 is an opening that allows lubricant to enter the vent 218. Vent opening 216 can be positioned relatively closer to a center of the distal end of shaft 208 than the lubricant outlet 214. In an embodiment, the vent opening 216 is positioned such that lubricant enters the vent opening 216 when at least some of the bearing surfaces 206 have received or are receiving lubricant. In an embodiment, vent opening 216 can be positioned such that lubricant only enters the vent opening 216 when the bearing surfaces 206 have received or are receiving lubricant. In an embodiment, vent opening 216 is the same size (e.g. diameter) as the lubricant outlet 214.

Lubricant received at vent opening 216 can enter vent 218. The vent 218 is a channel extending through a portion of the shaft 208, configured to convey lubricant from the vent opening 216 to the vent outlet 220. Vent 218 can include a first portion 218*a* extending along a length direction of shaft 208, and a second portion 218*b* extending from an outer surface of the shaft 208 to the first portion. In an embodiment, the first portion and the second portion are perpendicular to one another. In an embodiment, the first portion is a drilled hole through shaft 208, from the vent opening 216 to where the first portion 218*a* meets the second portion 218*b*. In an embodiment, the second portion is a straight hole from the outer surface of the shaft 208 to where the second portion 218*b* meets the first portion 218*a*. Vent 218 can extend a length such that vent outlet 220 is provided relatively below the rotor 210 along the length of the shaft 208. Vent outlet 220 is an opening configured to allow the lubricant to exit vent 218. Vent outlet 220 can be configured to release the lubricant into an internal space within a housing of compressor 200, such that the lubricant can fall to lubricant sump 224. In an embodiment, vent outlet 220 can be positioned such that the centrifugal force resulting from rotation of the shaft 208 can drive lubricant released from vent outlet 220 to contact a portion of stator 222 extending below rotor 210 and the vent outlet 220.

Stator 222 is a stator of an electric motor provided within compressor 200 to drive the shaft 208 by way of the rotor 210. The stator 222 can be configured to receive power from a VFD, such that the compressor can be operated at one of a range of operating speeds. Stator 222 can be attached to a housing of compressor 200, or fixed by any other suitable connections within compressor 200. Stator 222 can include a portion extending below the rotor 210 in a vertical direction of the compressor 200. In an embodiment, lubricant leaving the vent opening 216 can contact at least part of the portion of stator 222 extending below rotor 210, thereby cooling the stator 222 where the lubricant contacts the stator 222.

Lubricant sump 224 is a portion of the compressor 200 configured to receive and retain lubricant, such that the lubricant can be provided to lubricant pump 226. Lubricant sump 224 can be provided vertically below the bearing surfaces 206 within compressor 200, such that gravity returns the lubricant from the bearing surfaces 206 to the lubricant sump 224. Lubricant sump 224 can be a basin provided at a bottom of a housing of compressor 200, a separate basin, or any other suitable configuration for receiving and retaining the lubricant.

Figure 3:
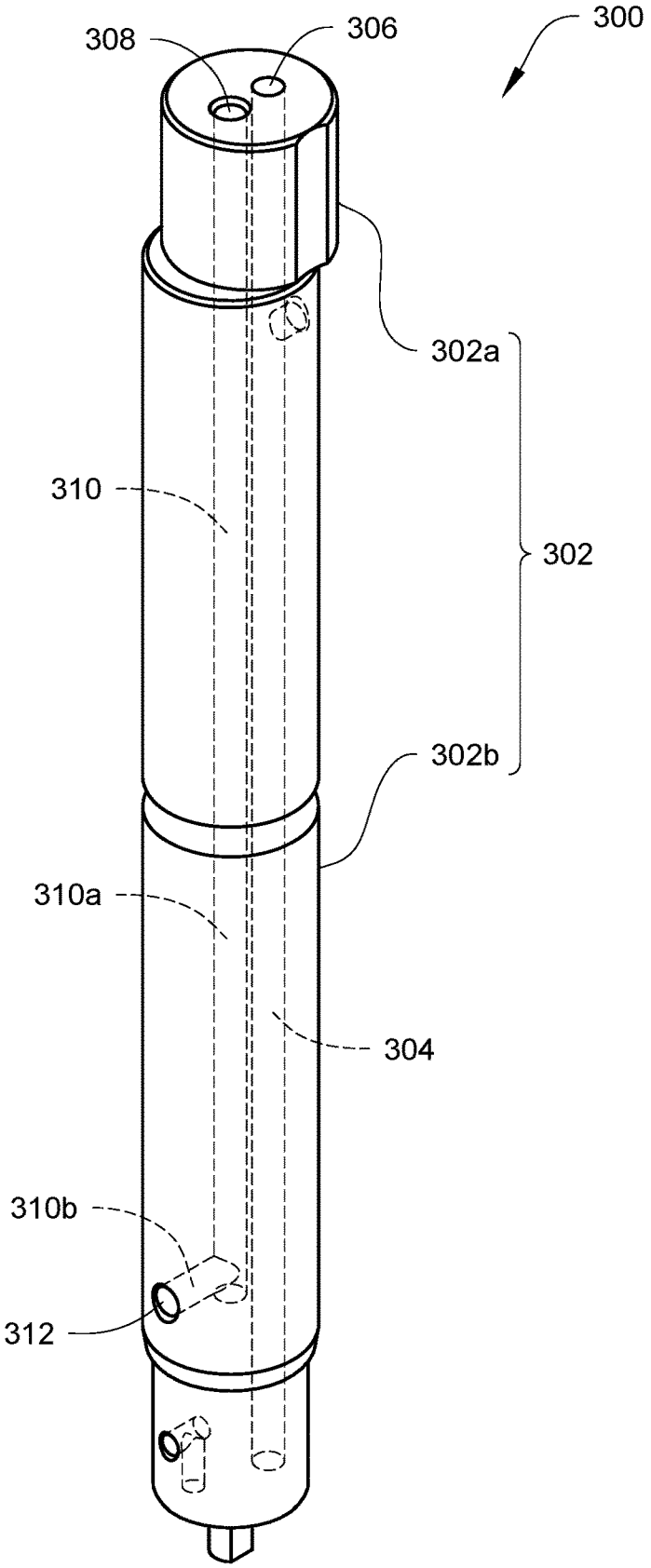
FIG. 3 shows a shaft for a compressor according to an embodiment.

Lubricant pump 226 is a pump configured to take lubricant from lubricant sump 224 and to drive said lubricant into and through lubricant channel 212. Lubricant pump 226 can be driven by the rotation of the shaft 208. When compressor 200 is operated, rotation of shaft 208 can drive the operation of lubricant pump 226 to supply lubricant from lubricant sump 224 to lubricant channel 210 to the bearing surfaces 206. Lubricant pump 226 can be any suitable type of pump for pumping the lubricant used in the compressor 200. In an embodiment, the lubricant pump 226 is a positive-displacement pump. In an embodiment, the lubricant pump 226 has a direct relationship between a speed of rotation of the shaft 208 during operation of the compressor 200 and a volume of lubricant driven by the lubricant pump 226, such as, as a non-limiting example, a linear relationship. In an embodiment, the lubricant pump 226 is a centrifugal pump, FIG. 3 shows a shaft for a compressor according to an embodiment. In an embodiment, the compressor including shaft 300 is the compressor 200 described above and shown in FIG. 2. Shaft 300 includes shaft body 302, lubricant channel 304, lubricant channel outlet 306, vent inlet 308, vent 310, and vent outlet 312.

Shaft 300 is configured to transfer rotational motion in a compressor, for example to drive an orbiting scroll or any other rotating member used in the compressor. Shaft 300 includes shaft body 302. Shaft body 302 is an elongate rounded body. In an embodiment, shaft body 302 has a circular cross-sectional shape. In an embodiment, a rotor can be attached to shaft body 302, for example along second portion 302*b*, to drive rotation of the shaft body 302. In an embodiment, first portion 302*a* of shaft body 302 can be offset relative to second portion 302*b* of shaft body 302. Shaft body 302 can be formed of any suitable material, such as iron, steel, or the like as non-limiting examples.

Lubricant channel 304 is a channel extending through shaft body 302. The lubricant channel is configured to convey lubricant from a lubricant disposed at or near one end of the shaft body 302 to the lubricant channel outlet 306. The lubricant channel 304 can be a drilled bore extending through at least a portion of the shaft body 302. In an embodiment, the lubricant channel 304 is offset from a center of the cross-sectional shape of the shaft body 302. The lubricant channel outlet 306 can be disposed at an end of the shaft body 302. The lubricant channel outlet 306 is an opening where lubricant being driven through the lubricant channel 304 can be released into the compressor including shaft 300. In an embodiment, multiple lubricant channel outlets 306 can be provided in shaft body 302. The number and location of lubricant channel outlets 306 can be based on the number and position of bearing surfaces in need of lubrication, such as thrust bearings, journal bearings, or any other bearing provided in the compressor including shaft 300. The lubricant channel outlet 306 can be at an opposite end of the shaft body 302 from a lubricant sump and/or a lubricant pump included in the compressor where shaft 300 is used. When lubricant exits the lubricant channel 304 at the lubricant channel outlet 306, centrifugal force from the rotation of shaft 300 can carry the lubricant outwards away from lubricant channel outlet 306 towards surfaces to be lubricated.

Vent inlet 308 can be positioned on the end of shaft body 302 where the lubricant channel outlet 306 is provided. In an embodiment, vent inlet 308 is located relatively closer to a center of the end of the shaft body 302 in second portion 302*b* than the lubricant channel outlet 306. In an embodiment, vent inlet 308 is positioned such that lubricant reaches vent inlet 308 following the receipt of lubricant at least at some bearing surfaces of the compressor to be lubricated by way of the lubricant from lubricant channel 304. In an embodiment, vent inlet 308 is positioned such that lubricant reaches vent inlet 308 only following the receipt of lubricant at all bearing surfaces of the compressor to be lubricated by way of the lubricant from lubricant channel 304. Vent inlet 308 allows the lubricant to enter vent 310. Vent 310 is a channel extending through shaft body 302, such that lubricant received at vent inlet 308 can pass to the vent outlet 312. In an embodiment, vent 310 includes a first segment 310*a* extending axially through the shaft body 302, and a second segment 310*b* extending radially through the shaft body 302 from the first segment 310*a* to the vent outlet 312. In an embodiment, the first segment 310*a* extends at an angle relative to an axial direction of the shaft body 302. In an embodiment, the second segment 310*b* extending to a vent outlet 312 is angled with respect to the radius of shaft 302. The vent outlet 312 is an opening at an end of vent 310 opposite the vent inlet 308, such that the lubricant can exit the vent 310. Vent outlet 310 can be positioned on a side of the shaft body 302, such that centrifugal force from the rotation of shaft 300 draw lubricant through the vent outlet 312. Vent outlet 312 can be positioned along the length of the shaft 300 such that the vent outlet is on an opposite side of a rotor attached to shaft body 302, such that lubricant exiting the vent outlet 312 does not fall into the stator-rotor portion of the compressor including shaft 300. In an embodiment, vent outlet 312 is positioned along the length of shaft 300 such that the lubricant exiting the vent outlet 312 and/or working fluid that has passed through vent 310 and exits the vent 310 at vent outlet 312 contacts a portion of a stator of the compressor, thereby providing supplemental cooling of the stator.

Figure 4:
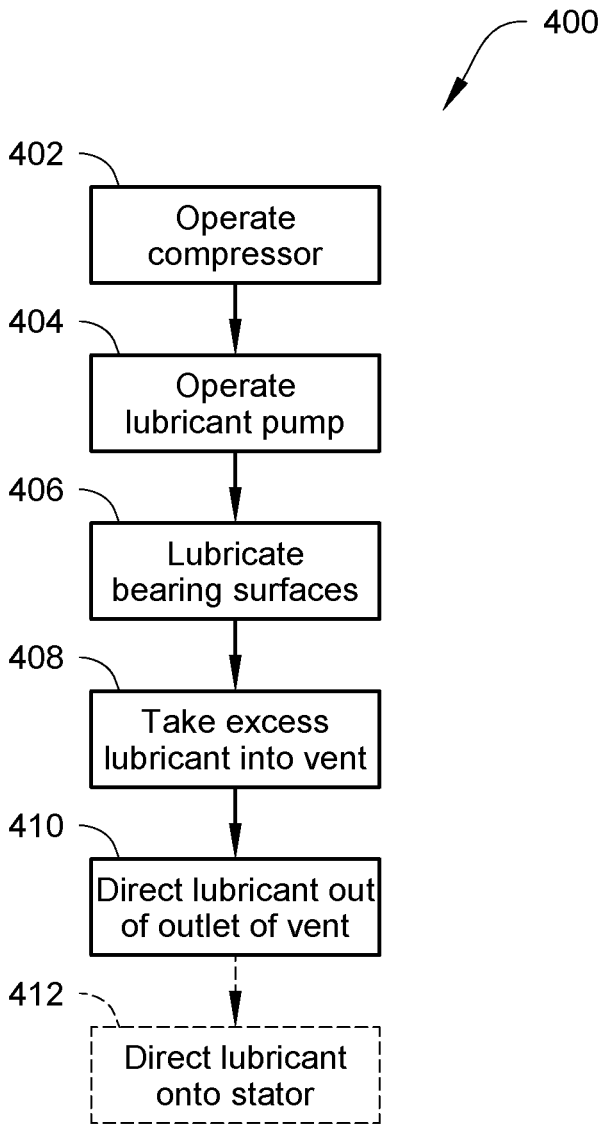
FIG. 4 shows a method according to an embodiment.

FIG. 4 shows a method according to an embodiment. Method 400 includes operating a compressor 402, operating a lubricant pump 404, lubricating bearing surfaces 406, receiving excess lubricant at an inlet for a vent 408, and releasing the excess lubricant from the vent 410. Optionally, method 400 can further include directing the excess lubricant onto a stator 412.

A compressor is operated at 402. The compressor can be any suitable compressor including a shaft, such as, as a non-limiting example, a scroll compressor. The compressor can be operated for any suitable purpose, for example to compress a working fluid in a circuit of a heating, ventilation, air conditioning, and refrigeration (HVACR) system. The operation of the compressor includes rotation of the shaft. In an embodiment, the compressor is a variable-speed compressor.

A lubricant pump is operated at 404. The lubricant pump can be any suitable pump for driving lubricant from a sump towards bearing surfaces of the compressor. In an embodiment, the lubricant pump is a positive displacement pump. In an embodiment, the lubricant pump is powered by the operation of the compressor such as the rotation of the shaft. In an embodiment, the volume of lubricant provided per unit time when the lubricant pump is operated at 404 can vary with a speed at which the compressor is operated at 402. The lubricant pump can pump lubricant through a lubricant channel provided in the pump to an outlet thereof.

Bearing surfaces are lubricated at 406. The lubricant at the outlet of the channel, driven by operation of the lubricant pump at 404, can then be directed to one or more bearing surfaces that are thereby lubricated at 406. The lubricant can be directed by, for example, centrifugal force, deflection or being directed by one or more surfaces or features provided thereon, flow due to the volume being provided by the lubricant pump, combinations thereof, and the like.

Excess lubricant is received at an inlet for a vent at 408. In an embodiment, the vent can be configured to receive lubricant only when the bearing surfaces are being lubricated, for example by having the inlet be located at or near a center of the shaft where centrifugal force is part of directing the lubricant to the bearing surfaces. The lubricant can then travel through the vent to reach an outlet.

At the outlet, the excess lubricant can be released from the vent at 410. The outlet can be positioned on a side wall of the shaft, for example below a rotor provided on the shaft. The excess lubricant can then flow down to the lubricant sump. Optionally, the excess lubricant leaving the vent can be directed onto a stator at 412. The vent can be positioned such that centrifugal force directs the lubricant onto a portion of the stator that extends below the rotor, thereby allowing the excess lubricant to provide supplemental cooling to a motor of the compressor. In an embodiment, when lubricant is not passing through the vent, a portion of the fluid being compressed can pass through the vent and onto the portion of the stator, thereby providing the supplemental cooling even when the lubricant supply does not include excess lubricant to be taken into the vent.

Aspects:

It is understood that any of aspects 1-15 can be combined with any of aspects 16-20.

Aspect 1. A compressor, comprising:

a stator;

a shaft;

a rotor, connected to the shaft;

a lubricant sump;

a lubricant pump;

a lubricant channel configured to convey lubricant from the lubricant pump to a distal end of the shaft, at least a portion of the lubricant channel extending through at least a portion of the shaft; and a vent extending through at least a portion of the shaft, the vent having an inlet at the distal end of the shaft, and an outlet disposed on a side wall of the shaft, between the lubricant sump and the rotor along the length of the shaft.

Aspect 2. The compressor according to aspect 1, wherein the compressor is a variable speed compressor.

Aspect 3. The compressor according to any of aspects 1-2, wherein the compressor includes an orbiting scroll and a fixed scroll.

Aspect 4. The compressor according to any of aspects 1-3, wherein the inlet of the vent is located at a center of the distal end of the shaft.

Aspect 5. The compressor according to any of aspects 1-4, wherein the lubricant pump is a positive displacement pump or a centrifugal pump.

Aspect 6. The compressor according to any of aspects 1-5, wherein the vent is positioned such that at least some of the fluid leaving the outlet contacts the stator when the compressor is in operation.

Aspect 7. The compressor according to any of aspects 1-6, further comprising a plurality of bearing surfaces configured to receive lubricant from the distal end of the shaft when the compressor is in operation.

Aspect 8. A heating, ventilation, air conditioning, and refrigeration (HVACR) system comprising the compressor according to aspect 1.

Aspect 9. The HVACR system according to aspect 8, further comprising a condenser, an expander, and an evaporator.

Aspect 10. The HVACR system according to any of aspects 8-9, wherein the compressor is a variable speed compressor.

Aspect 11. The HVACR system according to any of aspects 8-10, wherein the compressor includes an orbiting scroll and a fixed scroll.

Aspect 12. The HVACR system according to any of aspects 8-11, wherein the inlet of the vent is located at a center of the distal end of the shaft.

Aspect 13. The HVACR system according to any of aspects 8-12, wherein the lubricant pump is a positive displacement pump.

Aspect 14. The HVACR system according to any of aspects 8-13, wherein the vent is positioned such that at least some of the fluid leaving the outlet contacts the stator when the compressor is in operation.

Aspect 15. The HVACR system according to any of aspects 8-14, further comprising a plurality of bearing surfaces configured to receive lubricant from the distal end of the shaft when the compressor is in operation.

Aspect 16. A method, comprising:

operating a compressor;

operating a lubricant pump included in the compressor to drive lubricant through a lubricant channel, the lubricant channel extending through at least part of a shaft of the compressor;

lubricating one or more bearing surfaces of the compressor using at least some of the lubricant;

receiving excess lubricant at an inlet of a vent, the vent extending through at least part of the shaft of the compressor; and releasing the excess lubricant from the vent at an outlet.

Aspect 17. The method according to aspect 16, wherein releasing the excess lubricant from the vent at the outlet directs the excess lubricant to contact a stator of the compressor.

Aspect 18. The method according to any of aspects 16-17, wherein the lubricant pump is a positive displacement pump.

Aspect 19. The method according to any of aspects 16-18, wherein the compressor is a variable-speed compressor.

Aspect 20. The method according to any of aspects 16-19, wherein operating the compressor compresses a working fluid of a heating, ventilation, air conditioning, or refrigeration (HVACR) system.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A compressor, comprising:

a stator comprising stator windings, the stator attached to a housing of the compressor;

a shaft;

a rotor, connected to the shaft;

a lubricant sump;

a lubricant pump;

a lubricant channel configured to convey lubricant from the lubricant pump to a distal end of the shaft, at least a portion of the lubricant channel extending through at least a portion of the shaft; and a vent extending through at least a portion of the shaft, the vent having an inlet at the distal end of the shaft, and an outlet disposed on a side wall of the shaft, the outlet located at a position along a length of the shaft between the lubricant sump and an end of the rotor proximal to the lubricant sump, wherein the outlet is further positioned between the end of the rotor proximal to the lubricant sump and a portion of the stator winding extending below the rotor, such that at least a portion of the lubricant leaving the outlet contacts and cools the portion of the stator windings extending below the rotor when the compressor is in operation.

2. The compressor of claim 1, wherein the compressor is a variable speed compressor.

3. The compressor of claim 1, wherein the compressor includes an orbiting scroll and a fixed scroll.

4. The compressor of claim 1, wherein the inlet of the vent is located at a center of the distal end of the shaft.

5. The compressor of claim 1, wherein the lubricant pump is a positive displacement pump or a centrifugal pump.

6. The compressor of claim 1, further comprising a plurality of bearing surfaces configured to receive lubricant from the distal end of the shaft when the compressor is in operation.

7. A heating, ventilation, air conditioning, and refrigeration (HVACR) system comprising the compressor of claim 1.

8. The HVACR system of claim 7, further comprising a condenser, an expander, and an evaporator.

9. The HVACR system of claim 7, wherein the compressor is a variable speed compressor.

10. The HVACR system of claim 7, wherein the compressor includes an orbiting scroll and a fixed scroll.

11. The HVACR system of claim 7, wherein the inlet of the vent is located at a center of the distal end of the shaft.

12. The HVACR system of claim 7, wherein the lubricant pump is a positive displacement pump.

13. The HVACR system of claim 7, further comprising a plurality of bearing surfaces configured to receive lubricant from the distal end of the shaft when the compressor is in operation.

14. A method, comprising:

operating a compressor, wherein the compressor comprises a stator including stator windings, the stator attached to a housing of the compressor; a shaft; a rotor, connected to the shaft, a lubricant sump, a lubricant pump, a lubricant channel configured to convey lubricant from the lubricant pump to a distal end of the shaft, and a vent extending through at least a portion of the shaft, the vent having an inlet at the distal end of the shaft, and an outlet disposed on a side wall of the shaft;

operating the lubricant pump included in the compressor to drive lubricant through the lubricant channel, the lubricant channel extending through at least part of the shaft of the compressor to the distal end of the shaft;

lubricating one or more bearing surfaces of the compressor using at least some of the lubricant;

receiving excess lubricant at the inlet of the vent, the inlet at the distal end of the shaft, the vent extending through at least part of the shaft of the compressor; and releasing the excess lubricant from the vent at the outlet, wherein the outlet is located at a position along a length of the shaft between the lubricant sump and an end of a rotor proximal to the lubricant sump, and wherein the outlet is further positioned between the end of the rotor proximal to the lubricant sump and a portion of the stator windings extending below the rotor, such that at least a portion of the lubricant leaving the outlet contacts and cools the portion of the stator windings when operating the compressor.

15. The method of claim 14, wherein the lubricant pump is a positive displacement pump.

16. The method of claim 14, wherein the compressor is a variable-speed compressor.

17. The method of claim 14, wherein operating the compressor compresses a working fluid of a heating, ventilation, air conditioning, or refrigeration (HVACR) system.

* * * * *